US006501256B1

(12) United States Patent
Jaussi et al.

(10) Patent No.: US 6,501,256 B1
(45) Date of Patent: Dec. 31, 2002

(54) TRIMMABLE BANDGAP VOLTAGE REFERENCE

(75) Inventors: James E. Jaussi, Hillsboro, OR (US); Stephen R. Mooney, Beaverton, OR (US); Aaron K. Martin, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/897,792

(22) Filed: Jun. 29, 2001

(51) Int. Cl.[7] ..... G05F 3/16; G05F 3/20
(52) U.S. Cl. ..... 323/315; 323/316
(58) Field of Search ..... 323/316, 315, 323/313, 314

(56) References Cited

U.S. PATENT DOCUMENTS 5,325,045 A * 6/1994 Sundby ..... 323/313
5,963,105 A * 10/1999 Nguyen ..... 331/1 R
5,982,241 A * 11/1999 Nguyen et al. ..... 331/1 R
6,060,874 A * 5/2000 Doorenbos ..... 323/316
6,242,897 B1 * 6/2001 Savage et al. ..... 323/313
6,275,090 B1 * 8/2001 Burger et al. ..... 323/316

OTHER PUBLICATIONS

Banba, H., et al., "A CMOS Bandgap Reference Circuit with Sub–1–V Operation", *IEEE Journal of Solid–State Circuits*, vol. 34, 670–674, (May 1999).

* cited by examiner

*Primary Examiner*—Bao Q. Vu
(74) *Attorney, Agent, or Firm*—Schwegman, Lundberg, Wossener & Kluth P.A.

(57) ABSTRACT

A trimmable bandgap voltage reference circuit includes variable current sources to drive variable currents through parallel combination circuits. The parallel combination circuits include variable resistors and diodes of differing sizes. Voltages developed across the parallel combination circuits are input to a differential amplifier that is used as a feedback amplifier to bias the variable current sources. The variable current sources and variable resistors can all be digitally controlled. A processor can query the operating point of the bandgap voltage reference circuit, and can also set the current and resistance values through a control circuit.

30 Claims, 12 Drawing Sheets

TRIMMABLE BANDGAP VOLTAGE REFERENCE

FIELD

The present invention relates generally to voltage reference circuits, and more specifically to bandgap voltage reference circuits.

BACKGROUND OF THE INVENTION

Integrated circuits, and other electronic circuits, often require operating voltages that are stable over process, voltage, and temperature variations. One type of circuit that is commonly used to provide stable voltages is the bandgap voltage reference circuit. A bandgap voltage reference circuit takes advantage of the characteristics of the bandgap energy of a semiconductor material (e.g., silicon) to provide a stable reference voltage. At a temperature of absolute zero (i.e., zero Kelvin), the bandgap energy of a semiconductor material is typically a physical constant. As the temperature of the semiconductor material rises from absolute zero, the bandgap energy of the material decreases (i.e., a negative temperature coefficient is displayed).

The voltage across a forward biased PN junction (i.e., the junction between a positive (P) doped portion and a negative (N) doped portion of a semiconductor material) is an accurate indicator of the bandgap energy of a material. For this reason, the voltage across a forward biased PN junction will decrease as the temperature of the semiconductor material is raised. The rate at which the voltage decreases depends upon the junction (cross-sectional) area of the particular PN junction (as well as the semiconductor material being used). Therefore, the voltages across two forward biased PN junctions having different cross-sectional areas (but using the same semiconductor material) will vary at different rates with temperature, but each of these voltages can be traced back to the same bandgap voltage constant at absolute zero. The conventional bandgap voltage reference circuit utilizes the voltage relationships between two forward biased PN junctions having different cross-sectional areas to achieve a relatively temperature insensitive output voltage.

In a conventional bandgap voltage reference circuit, a feedback loop is used in conjunction with a differential amplifier to generate a reference voltage. The feedback loop maintains the two input nodes of the differential amplifier at approximately the same potential in the steady-state. A first input node (e.g., the non-inverting input node) of the differential amplifier is coupled to a reference potential through a first PN junction (e.g., a diode or transistor). A second input node (e.g., the inverting input node) of the differential amplifier is coupled to the reference potential through a resistor and a second PN junction that has a different cross-sectional area (typically larger) than the first PN junction. Substantially equal currents are forced through the first and second PN junctions during circuit operation. By carefully selecting circuit component values for the bandgap voltage reference circuit, a system can be achieved that balances the negative temperature coefficient associated with one of the PN junctions with a positive temperature coefficient associated with the difference in the PN junctions to generate a relatively temperature insensitive output voltage. For further discussion of bandgap voltage references, see H Banba, "A CMOS Bandgap Reference Circuit with Sub-1V Operation," IEEE Journal of Solid-State Circuits, Vol. 34, No. 5, May 1999.

Ideally, the gain of the differential amplifier is very high. In general, higher gain in the differential amplifier enables more voltage insensitivity to temperature. Many differential amplifiers have gain fluctuations as a function of common-mode input voltage. The steady-state common-mode voltage values at the input to the differential amplifier are a function of many variables, including the non-linear characteristics of the diodes or transistors used. The steady-state common-mode voltage values define an "operating point" of the bandgap voltage reference. By maintaining the operating point in a region of high gain, the bandgap voltage reference can provide a more stable output voltage.

For the reasons stated above, and for other reasons stated below which will become apparent to those skilled in the art upon reading and understanding the present specification, there is a need in the art for a method and apparatus to modify the operating point of bandgap voltage references.

DESCRIPTION OF EMBODIMENTS

Figure 1:
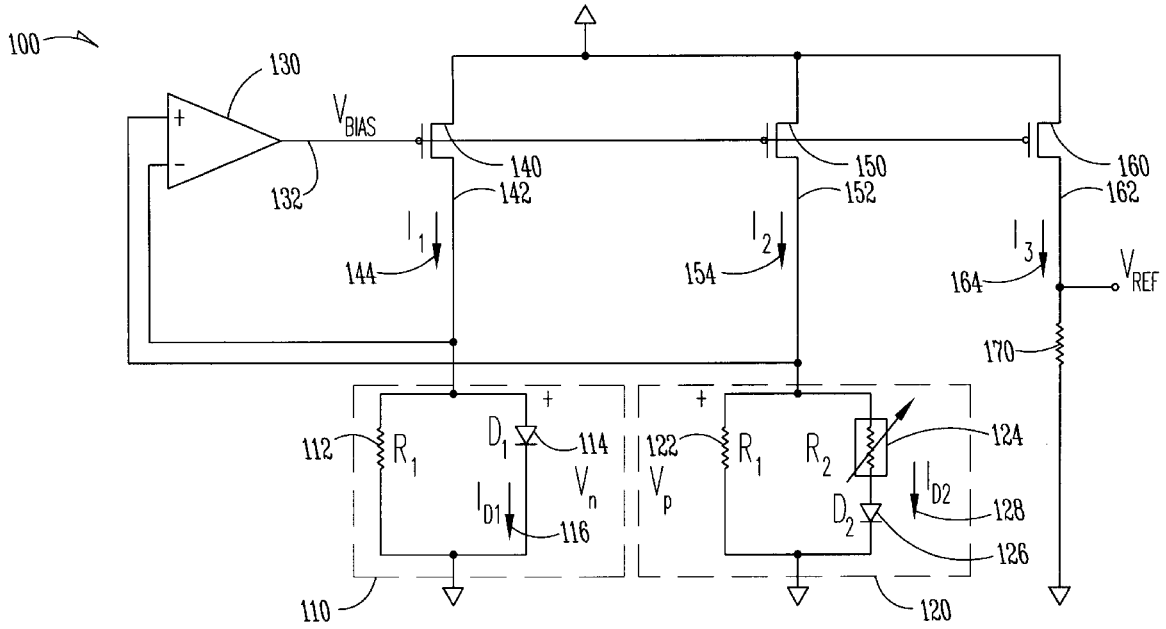
FIG. 1 shows a bandgap voltage reference circuit with a variable resistor.

In the following detailed description of the embodiments, reference is made to the accompanying drawings that show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

The method and apparatus of the present invention provide a mechanism to modify, or "trim," the operating point of a bandgap voltage reference. Variable resistors are provided in series and in parallel with diodes to vary the common mode voltages input to the differential amplifier in the steady-state. Variable current sources are also provided to vary the amount of current in the diodes used for the bandgap voltage reference circuit. By varying currents and resistance values, the operating point of the amplifier can be changed to effect any desired result. A control circuit provides an interface to external circuitry to facilitate the change in the operating point. The control circuit can include different types of registers and fusible links to maintain control data that sets the operating point of the bandgap voltage reference circuit. An analog-to-digital converter is provided so that the processor can "read" pertinent voltage values within the bandgap voltage reference circuit and modify the operating point in response thereto.

FIG. 1 shows a bandgap voltage reference circuit with a variable resistor. Bandgap voltage reference circuit 100 includes differential amplifier 130, current source transistors 140, 150, and 160, output resistor 170, and parallel combination circuits 110 and 120. Differential amplifier 130 drives node 132 with a bias voltage that biases current source transistors 140, 150, and 160. As a result, current source transistor 140 sources current 144 ($I_1$) to parallel combination circuit 110, current source transistor 150 sources current 154 ($I_2$) to parallel combination circuit 120, and current source transistor 160 sources current 164 ($I_3$) to output resistor 170. Differential amplifier 130 produces the bias voltage as a function of two input voltages, $V_n$ and $V_p$. $V_n$ is the voltage developed across parallel combination circuit 110 by current 144, and $V_p$ is the voltage developed across parallel combination circuit 120 as a result of current 154.

In embodiments represented by FIG. 1, current source transistors 140, 150, and 160 are P-channel metal oxide semiconductor field effect transistors (PMOSFETs), also referred to as "PFETs." Other types of transistors can also be used. For example, embodiments exist that utilize bipolar junction transistors (BJTs) and junction field effect transistors (JFETs). One of ordinary skill in the art will understand that many other types of transistors can be utilized without departing from the scope of the present invention.

A control loop is formed by the operation of differential amplifier 130, current source transistors 140 and 150, and parallel combination circuits 110 and 120. Differential amplifier 130 adjusts the bias voltage controlling current source transistors 140 and 150 to drive the difference between $V_n$ and $V_p$ to near zero. As a result, in operation, the voltages developed across parallel combination circuits 110 and 120 are substantially equal. In addition, in embodiments represented by FIG. 1, currents 144 and 154 are also substantially equal in part because current source transistors 140 and 150 receive the same bias voltage.

Parallel combination circuit 110 includes resistor 112 ($R_1$) in parallel with diode 114 ($D_1$). Diode 114 has a current shown as current 116 ($I_{D1}$) Parallel combination circuit 120 includes resistor 122 ($R_1$) in parallel with a series combination of variable resistor 124 ($R_2$) and diode 126 ($D_2$). The series combination of variable resistor 124 and diode 126 have a current flowing therethrough shown as current 128 ($I_{D2}$).

The first and second diodes 114, 126 are semiconductor structures that each include a PN junction. As will be appreciated, semiconductor devices other than diodes that include a PN junction can alternatively be used within the circuit 100. The second diode 126 has a cross-sectional area that is larger than that of the first diode 114. In one embodiment, for example, the cross-sectional area of the second diode 126 is approximately eight times that of the first diode 114. The second diode 126 can include a single diode having large dimensions or, alternatively, the second diode 126 can consist of a number of smaller devices connected in parallel to achieve a high effective cross-sectional area. In one embodiment, for example, the second diode 126 consists of eight diodes connected in parallel that are each substantially the same size as the first diode 114. Many other arrangements are also possible.

Differential amplifier 130 is a high gain amplifier. The gain of differential amplifier 130 is typically highest when operated with input voltages within a specified common-mode input voltage range. Resistor 124 within parallel combination circuit 120 is a variable resistor. By varying the resistance value of resistor 124, voltages $V_n$ and $V_p$ can be modified, thereby changing the input voltage levels to differential amplifier 130. The resistance value of resistor 124 can be maintained such that the input voltage levels to differential amplifier 130 are in a range to provide very high gain. This operation is described in more detail with reference to FIG. 2.

Figure 2:
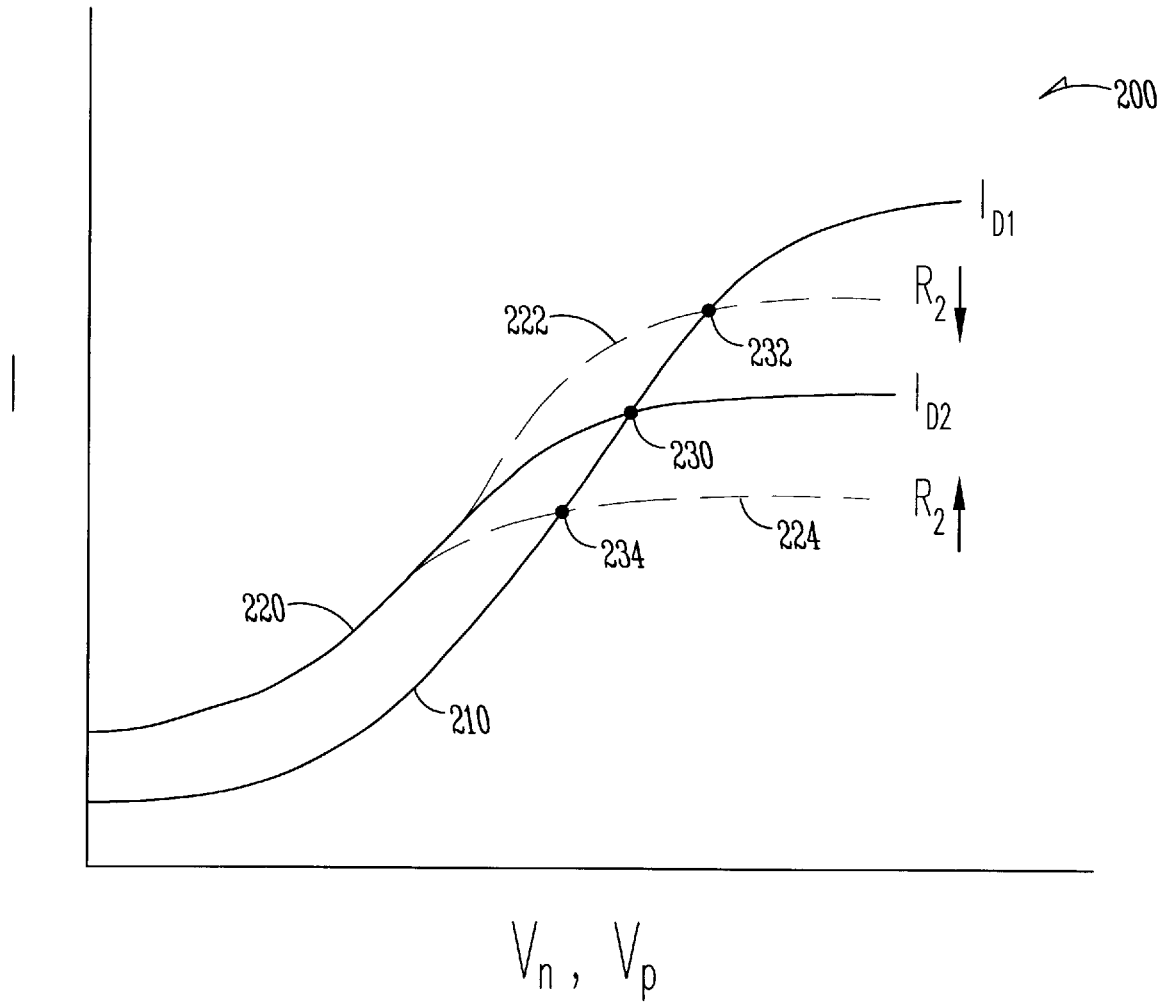
FIG. 2 is a graph showing an operating point of the circuit of FIG. 1.

FIG. 2 is a graph showing an operating point of the circuit of FIG. 1. Graph 200 shows current curve 210 ($I_{D1}$)and current curve 220 ($I_{D2}$). Current curve 210 corresponds to the current through diode 114 (FIG. 1) as a function of $V_n$. Current curve 220 represents the current through diode 126 as a function of $V_p$. These two curves cross at operating point 230. Operating point 230 corresponds to the steady-state voltage values at which $V_n$ and $V_p$ will operate based on the feedback loop shown in FIG. 1.

As resistor 124 is increased in value, more voltage is dropped across resistor 124, and a smaller voltage appears across diode 126. As a result, the current through diode 126 drops. This is shown by current curve 224. As a result of resistor 124 increasing in value, the operating point has moved from operating point 230 to operating point 234. Operating point 234 corresponds to differential amplifier 130 having lower common-mode input voltage values than operating point 230.

Current curve 222 corresponds to resistor 124 decreasing in value. As resistor 124 decreases in value, less voltage is dropped across the resistor, more voltage is dropped across diode 126, and the shape of current curve 222 approaches the shape of current curve 210. As a result, operating point 232 is formed with common-mode input voltages to differential amplifier 130 higher than for operating point 230.

By modifying the resistance value of resistor 124, the input voltages present at differential amplifier 130 are moved up or down. In some embodiments, resistor 124 is increased in value thereby decreasing the input voltages, and in other embodiments, resistor 124 is decreased in value thereby increasing the input voltages. By modifying the input voltages, differential amplifier 130 can be maintained in an operating range with very high gain.

Figure 3:
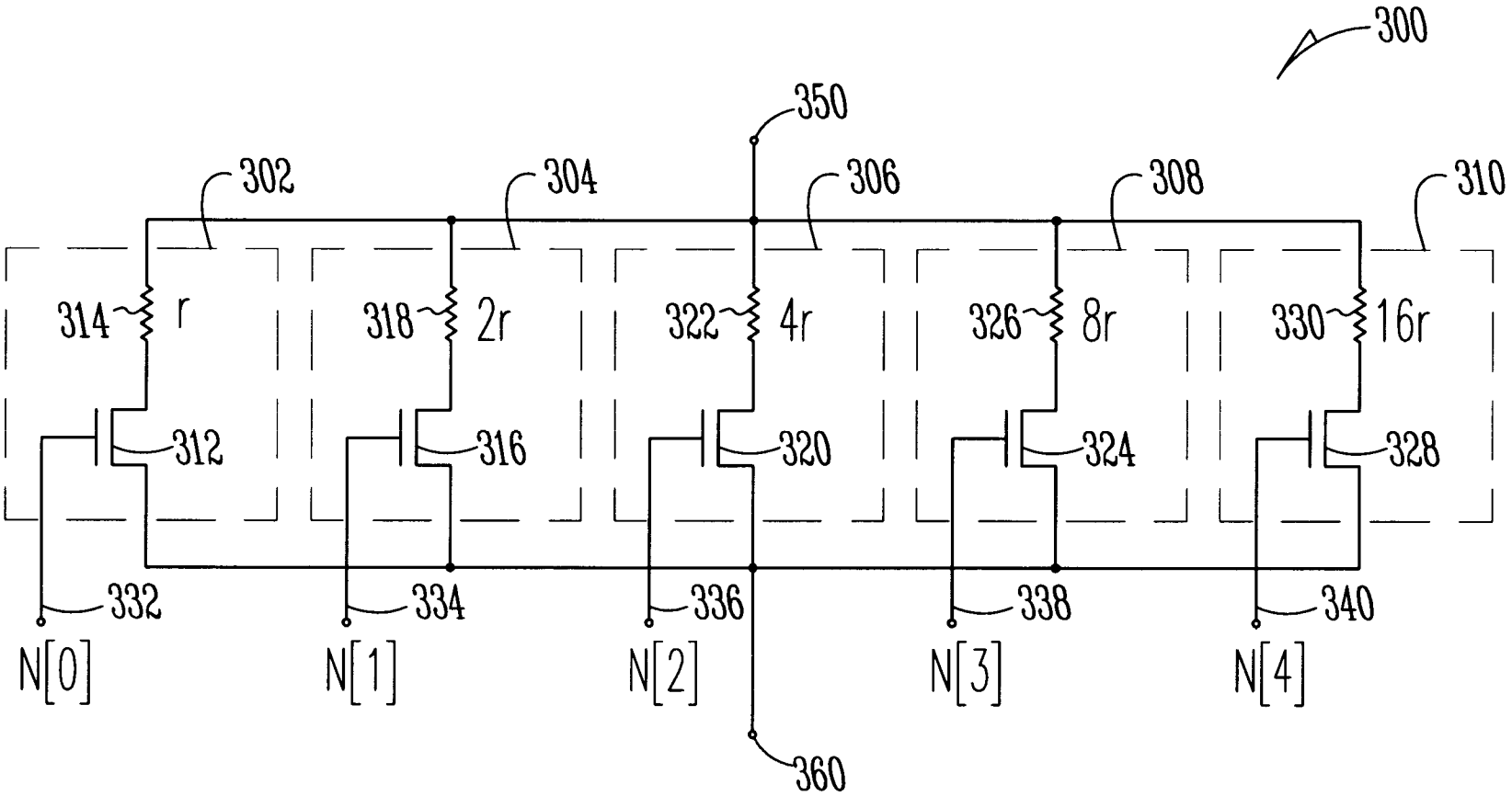
FIG. 3 shows a variable resistor.

FIG. 3 shows a variable resistor suitable for use as variable resistor 124 (FIG. 1). Variable resistor 300 includes multiple resistive devices, each having a control input node. For example, variable resistor 300 includes resistive devices 302, 304, 306, 308, and 310. Each of the resistive devices includes a transistor and a fixed value resistor. For example, resistive device 302 includes NFET 312 and resistor 314. Likewise, resistive devices 304, 306, 308, and 310 include NFETs 316, 320, 324, and 328 and resistors 318, 322, 326, and 330, respectively.

In embodiments represented by FIG. 3, transistors 312, 316, 320, 324, and 328 are N-channel metal oxide semiconductor field effect transistors (NMOSFETs), also referred to as "NFETs." Other types of transistors can also be used. For example, embodiments exist that utilize bipolar junction transistors (BJTs) and junction field effect transistors (JFETs). One of ordinary skill in the art will understand that many other types of transistors can be utilized without departing from the scope of the present invention.

Each resistive device is coupled in parallel between two reference nodes 350 and 360. Each resistive device includes a control input node having a signal that either turns on or turns off the NFET. For example, NFET 312 within resistive device 302 has a gate driven with the signal on control node 332. Likewise, control nodes 334, 336, 338, and 340 provide control signals to NFETs 316, 320, 324, and 328, respectively.

The resistors within the resistive devices can be any type of resistor fabricated on an integrated circuit. In some embodiments, resistors are fabricated as N-well resistors, as is known in the art. In the embodiment shown in FIG. 3, the resistive devices have binary weighted resistance values. For example, resistor 314 has a resistance value of "r," and resistor 318 has a resistance value of "2r." The resistance values double for each resistive device, and the largest resistance value of "16r" exists in resistive device 310.

Control input nodes 332, 334, 336, 338, and 340, taken together, form a control bus. In the embodiment of FIG. 3, this control bus is driven by a five bit wide signal labeled N[4:0]. The generation of this five bit wide signal is explained further with reference to later figures. By varying which control signals are asserted, 31 different resistance values can be obtained between nodes 350 and 360.

Variable resistor 300 has been described with resistive devices, each including a resistor with a binary weighting relative to the other resistors. Any number of resistive devices can be included without departing from the scope of the present invention. Binary weighting can be maintained with a large number of resistive devices, or a linear weighting can be employed. For example, variable resistor 300 can be implemented with each resistive device including a resistor of equal value. This reduces the number of possible resistance values available, but also reduces the possibility of a transient resistance value appearing when signal values on the input bus change.

Figure 4:
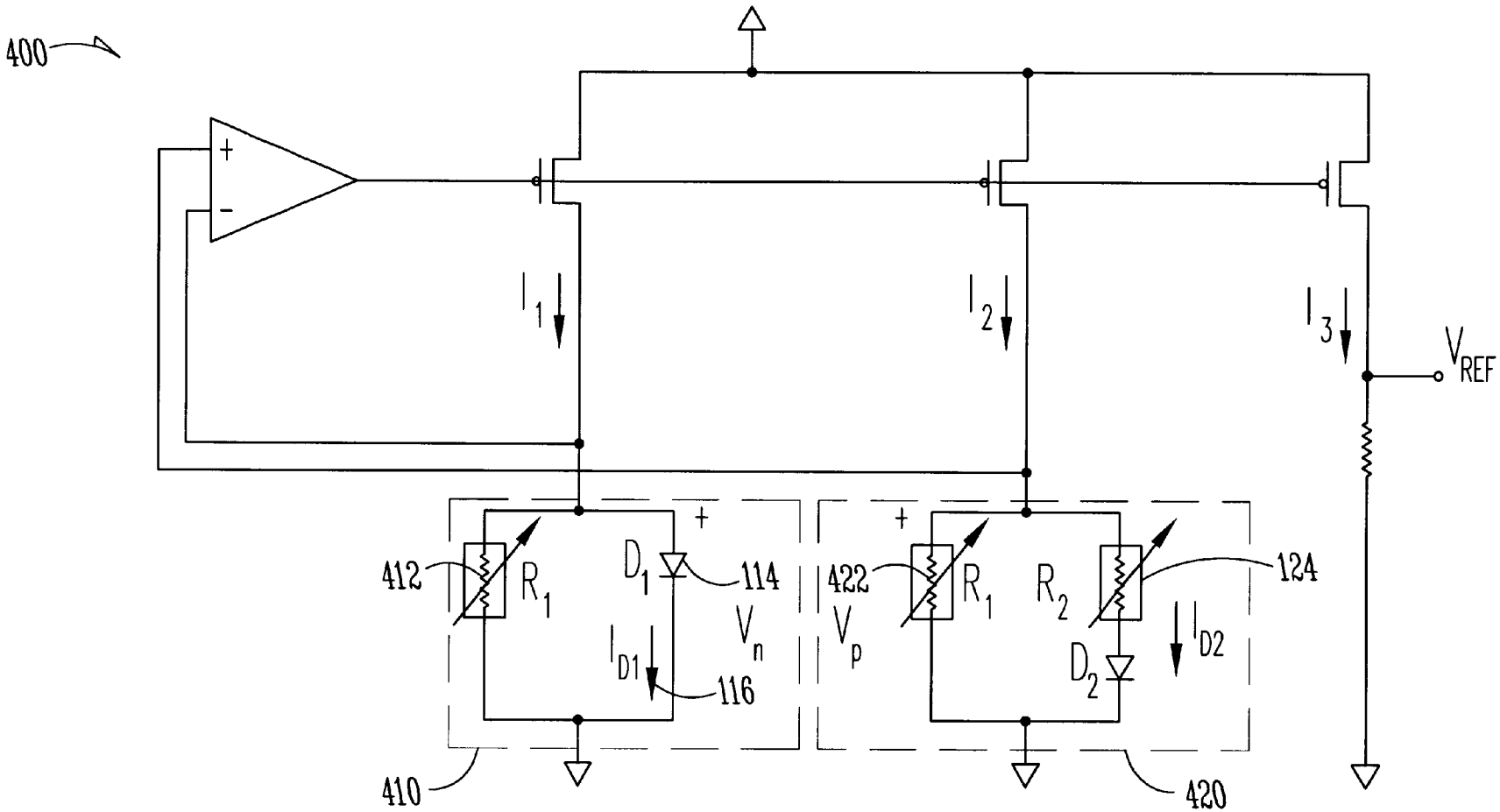
FIG. 4 shows a bandgap voltage reference circuit with multiple variable resistors.

FIG. 4 shows a bandgap voltage reference circuit with multiple variable resistors. Bandgap voltage reference circuit 400 includes the same circuit components as bandgap voltage reference circuit 100 (FIG. 1), with the exception of the parallel combination circuits. Parallel combination circuits 410 and 420 include variable resistors 412 and 422 in place of fixed value resistors shown in FIG. 1. As a result of modifying the resistance value of resistor 124, as explained above, temperature compensation properties of the bandgap voltage reference circuit may become upset. Variable resistors 412 and 422 provide a mechanism to compensate for temperature variations once resistor 124 is modified to change the operating point of the circuit. For example, the reference output voltage is given by:

$$V_{REF} = \left(\frac{V_{D1}}{R_1} + \frac{\Delta V_D}{R_2}\right)R_3 \tag{1}$$

where $\Delta V_D = V_{D1} - V_{D2}$, and the change in the reference output voltage as a function of change in temperature is approximately given by:

$$\frac{\partial V_{REF}}{\partial T} = \frac{-2mV/^\circ\ C.}{R_1} + \frac{.085mV/^\circ\ C.}{R_2} \tag{2}$$

As can be seen from the equations above, the ratio of resistance values R1 and R2 provides temperature compensation within bandgap voltage reference circuit 400. As described above with reference to the earlier figures, the operating point can be modified by adjusting the resistance value of resistor 124. In embodiments represented by FIG. 4, resistors 412 and 422 can also be modified to arrange the ratio of resistance values so as to provide temperature compensation. A variable resistor such as variable resistor 300 can be used to implement the various variable resistors of FIG. 4. Bandgap voltage reference circuit 400 is useful to modify the operating point of the differential amplifier, thereby providing high gain and good closed loop performance. Bandgap voltage reference circuit 400 also provides a mechanism to compensate for temperature variations for any given operating point that has been created by modifying resistance 124.

Figure 5:
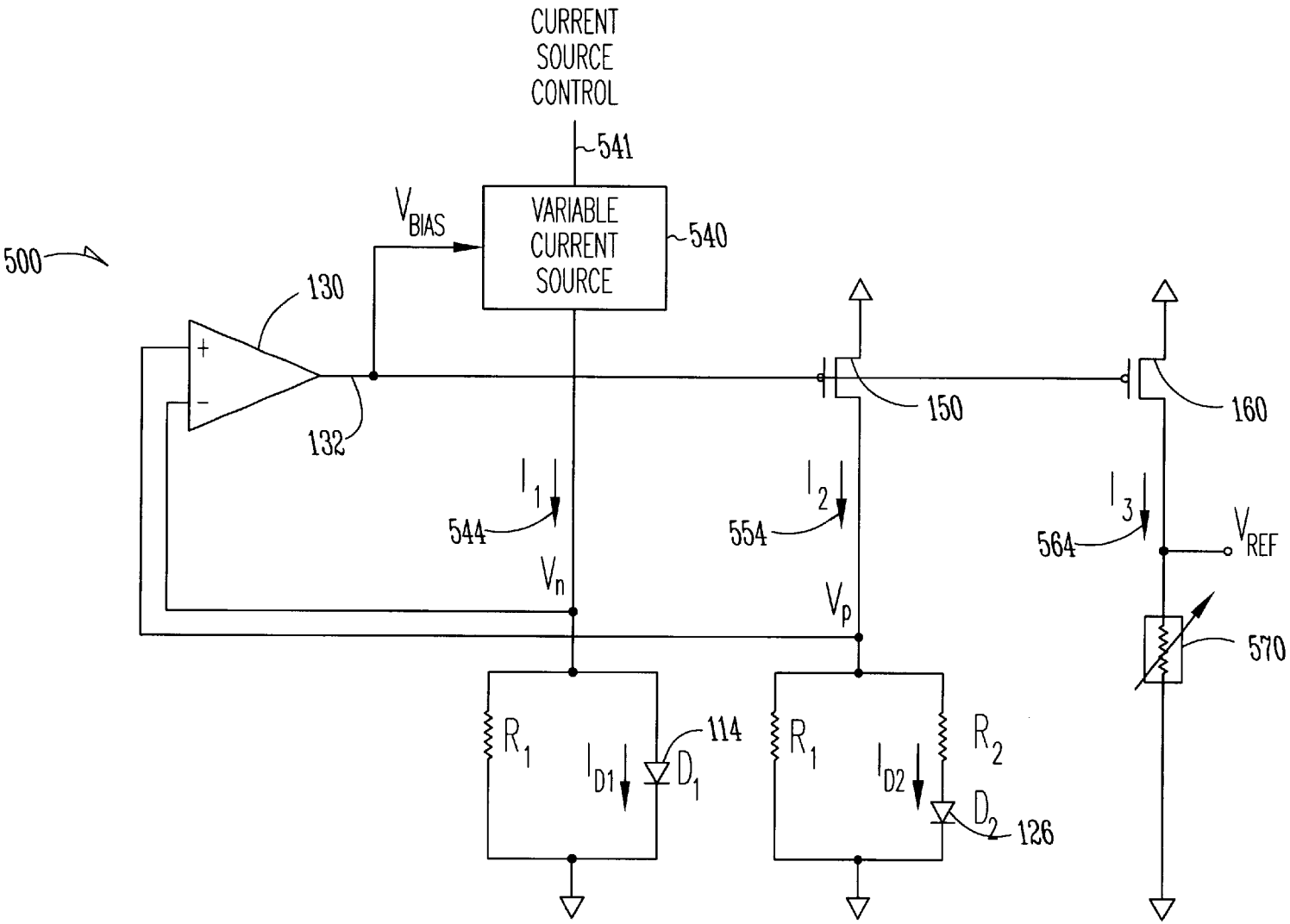
FIG. 5 shows a bandgap voltage reference circuit with a variable current source.

FIG. 5 shows a bandgap voltage reference circuit with a variable current source. Bandgap voltage reference circuit 500 includes circuit components similar to those shown in FIGS. 1 and 4. Exceptions include variable current source 540 and variable output resistor 570. Differential amplifier 130 presents a bias voltage on node 132. This bias voltage biases current source transistors 150 and 160, and also biases variable current source 540. In addition to the bias voltage, variable current source 540 receives current source control information on node 541. In embodiments represented by FIG. 5, current 544 is a function of the bias voltage on node 132 and the current source control information on node 541.

In operation, current source control information on node 541 is varied to control the current 544 sourced by variable current source 540 to drive differential amplifier 130 input voltages $V_n$ and $V_p$ to a desirable range. When the current source control information on node 541 is varied, current 544 can be greater than or less than current 554 during steady-state operation. Therefore, in steady-state operation of bandgap voltage reference circuit 500, currents 544 and 554 are not necessarily equal. A graph showing the resulting change in operating point is shown in FIG. 6 below.

Bandgap voltage reference circuit 500 includes variable output resistor 570. In embodiments represented by FIG. 5, output resistor 570 is a variable resistor to allow the output voltage $V_{REF}$ to be controlled independent of current 564. This can be useful when current 564 is substantially modified as a result of modifying current 544 through variable current source 540. Variable resistor 570 can be any type of suitable variable resistor, including that described with reference to FIG. 3.

Figure 6:
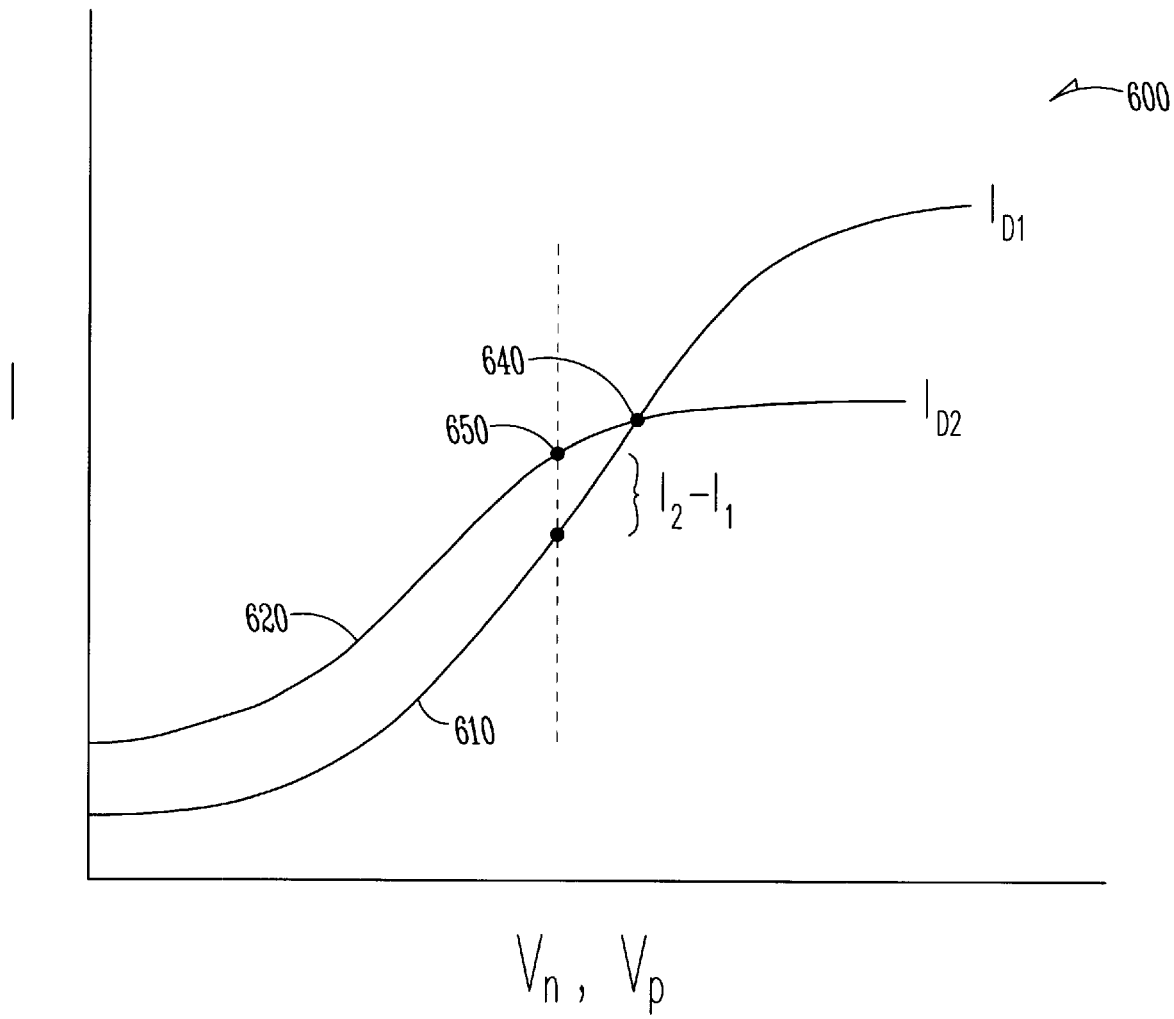
FIG. 6 is a graph showing an operating point of the circuit of FIG. 5.

FIG. 6 is a graph showing an operating point of the circuit of FIG. 5. Graph 600 shows current curves 610 ($I_{D1}$) and 620 ($I_{D2}$). Current curves 610 and 620 correspond to the currents through diodes 114 and 126, respectively. Operating point 640 represents the input voltage values for differential amplifier 130 during steady-state operation when currents 544 and 554 are substantially equal. Operating point 650 shows a new value for the differential amplifier input voltages when current 544 is decreased. When current 544 is decreased through the action of variable current source 540, the steady-state currents in the two parallel combination circuits are not equal. In the steady-state operating example of FIG. 6, current 544 has been decreased such that the steady-state current through diode 114 is lower than the steady-state current through diode 126. As a result, operating point 640 moves to the left to become operating point 650. As in the embodiments described previously, the operating point of the circuit has been moved to a point that allows the differential amplifier to operate with very high gain. At other steady-state operating points, current 544 is increased such that the steady-state current through diode 114 is greater than the steady-state current through diode 126. At these operating points, the operating point moves to the right, and the steady-state differential amplifier input voltages increase.

Graph 600 illustrates the operating point decreasing as a result of an decreasing current, and other embodiments have been described wherein the operating point is increased by increasing the current. In still further embodiments, a variable current source is provided in place of current source transistor 150 (FIG. 5) and the current represented by current curve 620 changes rather than the current represented by current curve 610.

Figure 7:
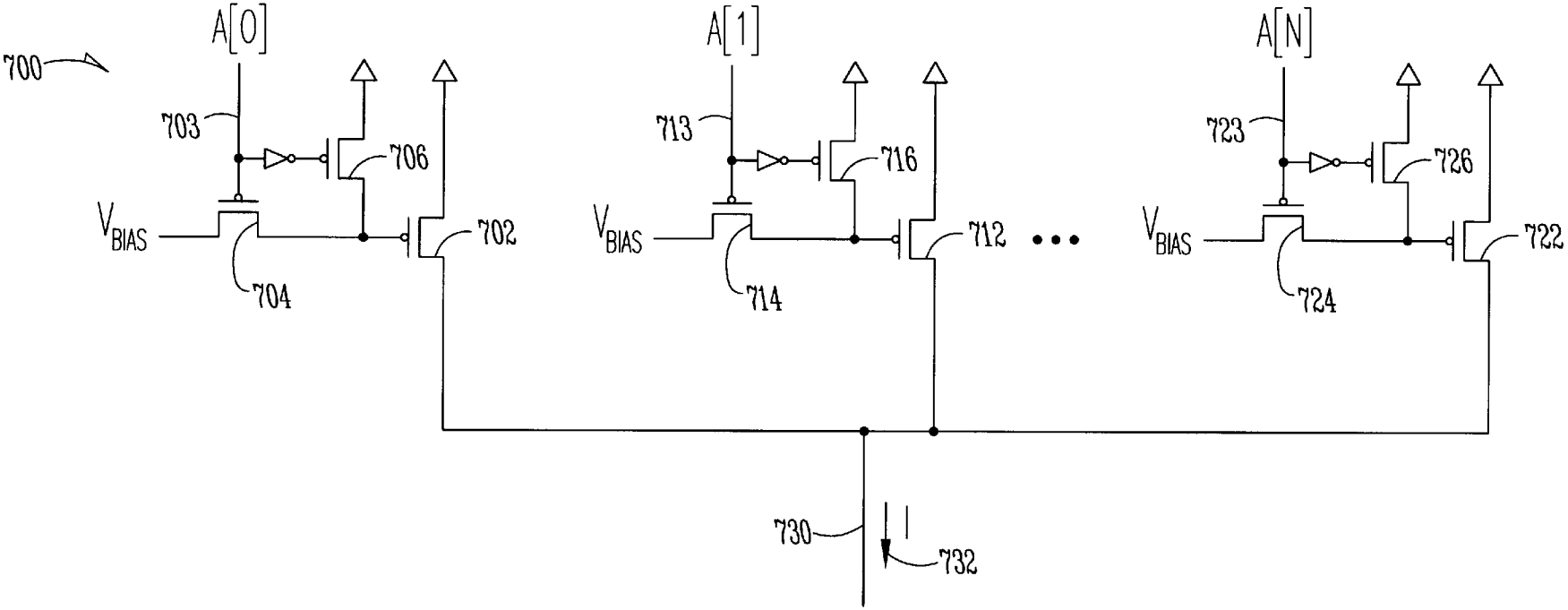
FIG. 7 shows a variable current source.

FIG. 7 shows a variable current source suitable for use as current source 540 (FIG. 5). Current source 700 includes a plurality of selectable current source circuits. For example, one selectable current source circuit includes current source transistor 702 and select transistors 704 and 706. Likewise, another selectable current source circuit includes current source transistor 712 and select transistors 714 and 716. Furthermore, another selectable current source circuit includes current source transistor 722 and select transistors 724 and 726. Current source 700 is shown having three selectable current source circuits, but any number of selectable current source circuits can be included without departing from the scope of the present invention. In these embodiments, the signals shown controlling select transistors 704, 706, 714, 716, 724, and 726 are current source control signals provided to vary the amount of current 732 supplied by variable current source 700.

In operation, a current source transistor is selected by varying the signals controlling the select transistors connected thereto. As shown in FIG. 7, the signals that control the select transistors are present on control input nodes 703, 713, and 723. Control input nodes 703, 713, and 723, taken together, form a control bus. In embodiments represented by FIG. 7, this control bus is driven by an (N+1) wide control signal labeled A[N:0]. Control signal A[N:0] corresponds to the current source control information on node 541 (FIG. 5). The generation of this control signal is explained further with reference to later figures.

By varying which control signals are asserted, different current values can be obtained for current 732 on node 730. For example, current source transistor 702 has a gate coupled to a bias voltage through select transistor 704 and coupled to a reference potential through select transistor 706. When control signal A[0] is asserted, select transistor 704 conducts and select transistor 706 does not. As a result, current source transistor 702 has the bias voltage imposed from gate to source thereby providing a current that contributes to current 732 on node 730. When control signal A[0] is de-asserted, select transistor 704 is off and select transistor 706 is on, thereby coupling the gate of current source transistor 702 to the reference potential and turning current source transistor 702 off.

As used herein, the term "asserted" refers to a logical assertion of a signal, and does not refer to a specific logic or voltage level. For example, when control signal A[0] is asserted, a low voltage is presented to turn on transistor 704 and turn off transistor 706. In other embodiments, asserted signals have a high voltage.

Any number of current source transistors can be on, and any number of current source transistors can be off, based on the values of the control signals shown in FIG. 7. In embodiments represented by FIG. 7, each current source transistor sources substantially the same current when the bias voltage is applied to the gate. In other embodiments, different bias voltages are provided to the different current source transistors, thereby providing a different weight to each selectable current source circuit. In still other embodiments, each current source transistor is a different size, thereby providing a different amount of current from the same bias voltage. For example, each current source transistor can be sized in a binary fashion such that a binary control word can be applied to variable current source 700 to provide a greater range of current values.

Figure 8:
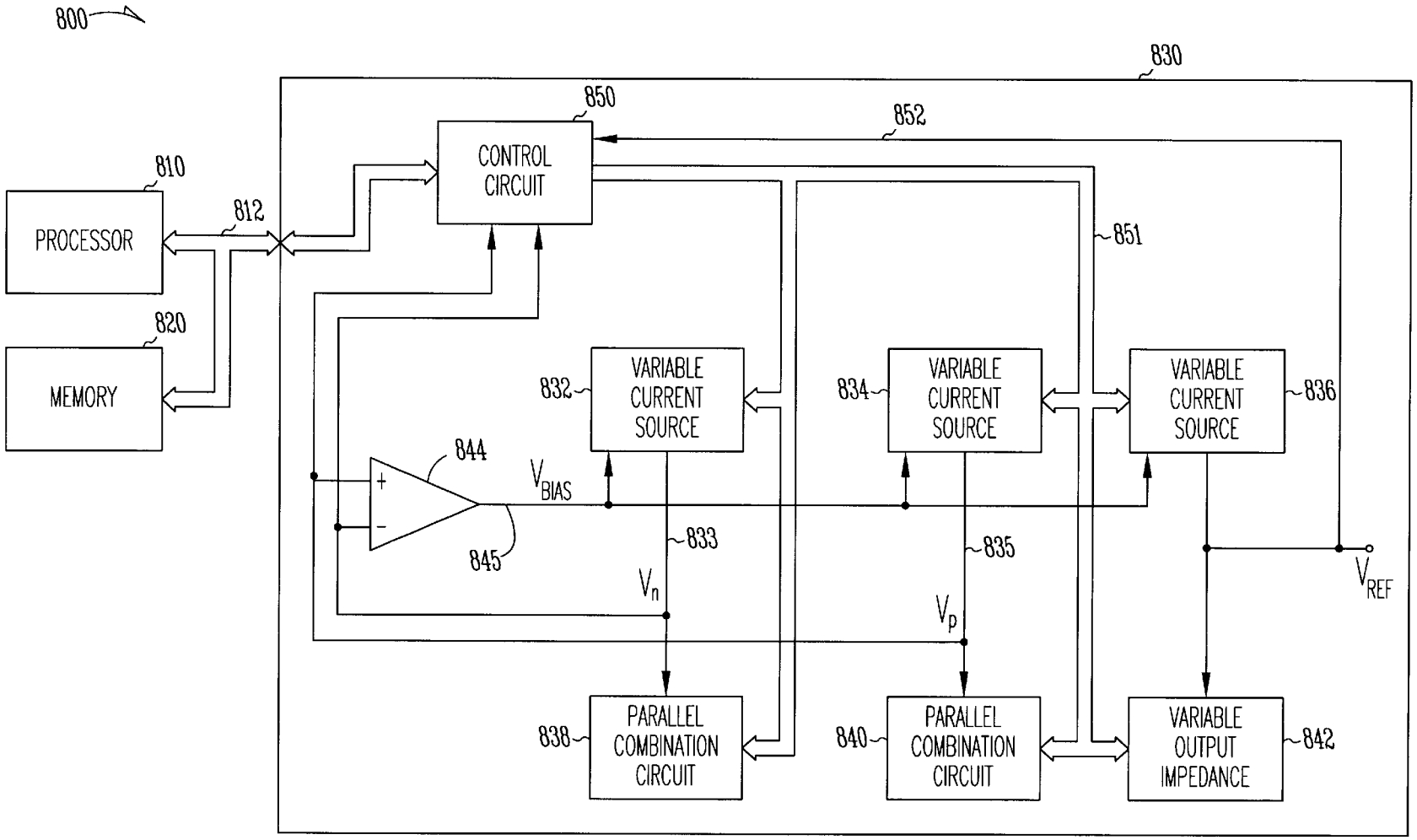
FIG. 8 shows an electronic system.

FIG. 8 shows an electronic system. System 800 includes processor 810, memory 820, and integrated circuit 830. Integrated circuit 830 includes control circuit 850, differential amplifier 844, variable current sources 832, 834, and 836, parallel combination circuits 838 and 840, and variable output impedance 842.

Control circuit 850 communicates with processor 810 and memory 820, and provides control information on node 851 to various circuits within integrated circuit 830. Node 851 is shown as an arrow in FIG. 8 to indicate that many physical traces can exist within integrated circuit 830 to disseminate the control information from control circuit 850 to the various other circuits within integrated circuit 830. For example, in some embodiments, control circuit 850 provides separate signals paths dedicated to each circuit element within integrated circuit 830. In other embodiments, signal paths are shared between the various elements, and signals are time-multiplexed on the shared signal paths.

The combination of variable current sources 832, 834, and 836, parallel combination circuits 838 and 840, variable output impedance 842, and differential amplifier 844 provides a bandgap voltage reference circuit to produce a reference voltage ($V_{REF}$) on node 852. Variable current source 832 provides current to parallel combination circuit 838, and voltage $V_n$ is produced on node 833 as a result. Likewise, variable current source 834 provides current to parallel combination circuit 840, and voltage $V_p$ is produced on node 835 as a result. Differential amplifier 844 receives $V_n$ and $V_p$ as input voltages, and produces the bias voltage on node 845, to bias the variable current sources and to drive the difference between $V_n$ and $V_p$ to near zero. Variable current source 836 receives the bias voltage and provides a current to variable output impedance 842, and produces the reference output voltage $V_{REF}$ on node 852.

Variable current sources 832, 834, and 836 each provide currents in response to the bias voltage provided by differential amplifier 844, and also in response to the control information provided by control circuit 850. The currents provided by the various variable current sources need not be equal. Each variable current source can be independently controlled such that the current from one variable current source may be greater than the current from another. In some embodiments, the variable current sources shown in FIG. 8 are implemented as variable current source 700 (FIG. 7).

Parallel combination circuits 838 and 840 each receive current from a variable current source and have a voltage produced as a result. For example, voltage $V_n$ is produced across parallel combination circuit 838, and voltage $V_p$ is produced across parallel combination circuit 840. In some embodiments, parallel combination circuits 838 and 840 include variable resistors that can be modified by control information received by control circuit 850. For example, parallel combination circuit 838 can be implemented as parallel combination circuit 410 (FIG. 4), and parallel combination circuit 840 can be implemented as parallel combination circuit 420 (FIG. 4).

Variable output impedance 842 includes a variable resistor that can be controlled by control information provided on node 851 by control circuit 850. In some embodiments, variable output impedance 842 is implemented as variable resistor 300 (FIG. 3). The current provided by variable current source 836 together with the impedance provided by variable output impedance 842 produce the output voltage of the bandgap voltage reference circuit on node 852.

System 800 is capable of controlling the steady-operating point of the bandgap voltage reference circuit shown in FIG. 8. For example, control circuit 850 can control the currents provided by the variable current sources, and can also control various elements within the parallel combination circuits. As a result, steady-state currents and voltages on nodes 833 and 835 can be set to values to achieve any desired result. For example, in some embodiments, the voltages $V_n$ and $V_p$ are set to be within a desired voltage range as input signals to differential amplifier 844. In other embodiments, currents on nodes 833 and 835 are set to be in desired operating ranges for parallel combination circuits 838 and 840.

In operation, processor 810 reads instructions and data from memory 820 and communicates with integrated circuit 830 on bus 812. Control circuit 850 receives data from processor 810 and provides it to other circuits on node 851, and receives data from various circuits within integrated circuit 830 and provides it to processor 810. For example, control circuit 850 receives current control information data from processor 810 and provides it to variable current sources 832, 834, and 836. Also for example, control circuit 850 receives voltages $V_n$, $V_p$, and $V_{REF}$ on nodes 833, 835, and 852, respectively, and provides the voltage values to processor 810.

Although processor 810 and integrated circuit 830 are shown separate in FIG. 8, embodiments exist that combine the circuitry of processor 810 and integrated circuit 830 in a single integrated circuit. Furthermore, integrated circuit 830 can be any type of integrated circuit capable of including a bandgap voltage reference circuit. For example, integrated circuit 830 can be a processor such as a microprocessor, a digital signal processor, a microcontroller, or the like. Integrated circuit 830 can also be an integrated circuit other than a processor such as an application-specific integrated circuit (ASIC), a communications device, a memory controller, or a memory such as a dynamic random access memory (DRAM).

Memory 820 represents an article that includes a machine readable medium. For example, memory 820 represents any one or more of the following: a hard disk, a floppy disk, random access memory (RAM), read only memory (ROM), flash memory, CDROM, or any other type of article that includes a medium readable by processor 820. Memory 820 can store instructions for performing the execution of the various method embodiments of the present invention.

Figure 9A:
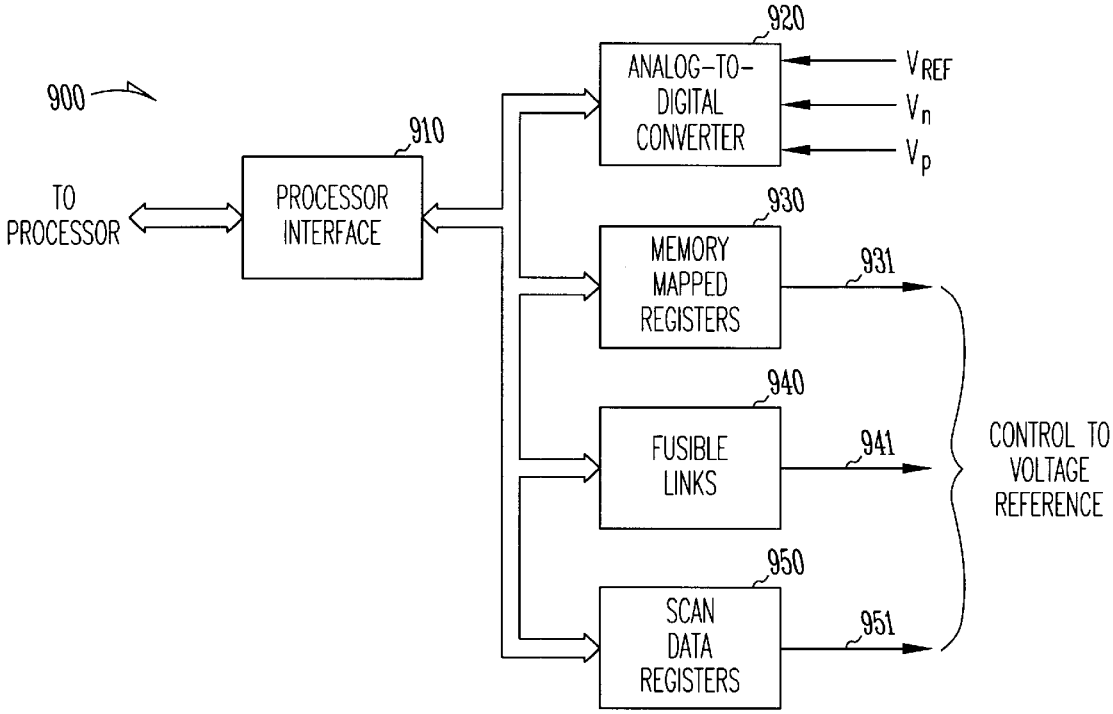
FIGS. 9A and 9B show control circuits.

FIG. 9A shows a control circuit. Control circuit 900 is a control circuit suitable for use as control circuit 850 (FIG. 8). Control circuit 900 includes processor interface 910, analog-to-digital converter (A/D) 920, memory mapped registers 930, fusible links 940, and scan data registers 950. Processor interface 910 includes circuitry to interface a processor such as processor 810 (FIG. 8) to the remaining circuitry shown in FIG. 9. In some embodiments, processor interface 910 includes decoding logic to decode address information from the processor and multiplexors to collect data from the various other circuits shown in FIG. 9.

Each of memory mapped registers 930, fusible links 940, and scan data registers 950 provide mechanisms to control the bandgap voltage reference circuit shown in FIG. 8. For example, memory mapped registers 930 include registers addressable by a processor that can be written to provide control information on node 931. Scan data registers 950 can also be written to provide the control information. In embodiments that include scan data registers, processor interface 910 includes scan interface circuitry that allows a scan chain to be implemented within the integrated circuit. The data maintained in memory mapped registers 930 and scan data registers 950 can be modified at anytime through the action of processor interface 910. Fusible links 940 also provide control information to the bandgap voltage reference circuit. Fusible links 940 are one-time programmable links that are "blown" to provide static control information on node 941.

In some embodiments, memory mapped registers 930, scan data registers 950, and fusible links 940 all co-exist in the same integrated circuit, and in other embodiments, a subset of memory mapped registers 930, scan data registers 950, and fusible links 940 exist within the integrated circuit.

For example, in some embodiments, the bandgap voltage reference circuit is controlled only by memory mapped registers 930, and node 931 corresponds to node 851 (FIG. 8). In these embodiments, a processor controls the operating point of the bandgap voltage reference by writing control information to memory mapped registers.

Also for example, in some embodiments, the bandgap voltage reference circuit is controlled only by scan data registers 950, and node 951 corresponds to node 851 (FIG. 8). In these embodiments, the bandgap voltage reference circuit is controlled by scan data that is shifted in to scan data registers 950. Also in these embodiments, processor interface 910 includes a scan interface that provides data shifting capabilities to shift scan data in and out of the integrated circuit.

Also for example, in some embodiments, the bandgap voltage reference circuit is controlled only by fusible links 940. In these embodiments, node 941 corresponds to node 851 (FIG. 8). In these embodiments, the bandgap voltage reference circuit is controlled by static data that is set when the fusible links are blown. These embodiments can be useful where the operating point of the bandgap voltage reference circuit is to be set and never changed. For example, during manufacture, integrated circuits are often produced in large "lots" that have similar device characteristics that are a function of process parameters. A few integrated circuits within the lot can be sampled, and then the fusible links in all of the integrated circuits can be blown to set the bandgap voltage reference circuit operating points of the entire lot.

In some embodiments represented by FIG. 9A, analog-to-digital converter (A/D) 920 receives $V_{REF}$, $V_n$, and $V_p$ from the bandgap voltage reference circuit, digitizes them, and makes them available to processor interface 910. Through the action of A/D 920, a processor can "read" the operating point of the bandgap voltage reference, and modify, or "trim" the operating point. For example, the processor can read the steady-state voltage values of $V_n$ and $V_p$, and move the values up or down by modifying resistance values or current values within the circuit. Also for example, the processor can read the output voltage value, $V_{REF}$, and change the output voltage value by modifying the output impedance or the current passing through the output impedance. In some embodiments, A/D 920 does not receive $V_n$ and $V_p$. In these embodiments, A/D 920 receives $V_{REF}$, and modifies the operating point based on the value of $V_{REF}$ alone.

Figure 9B:
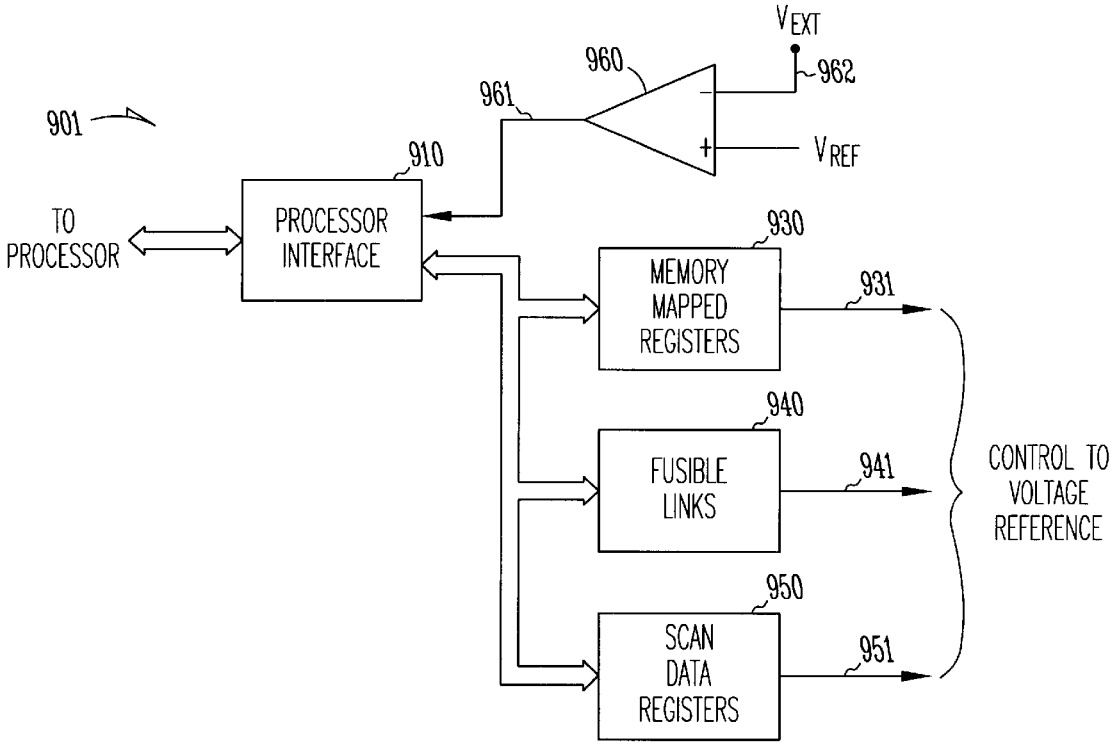

FIG. 9B shows another control circuit. Control circuit 901 is a circuit suitable for use as control circuit 850 (FIG. 8). Similar to control circuit 900 (FIG. 9A), control circuit 901 includes processor interface 910, memory mapped registers 930, fusible links 940, and scan data registers 950. Control circuit 901 also includes comparator 960. Comparator 960 compares $V_{REF}$ to an external voltage $V_{EXT}$. and provides the result to processor interface 910 on node 961. In some embodiments, $V_{EXT}$ is a voltage provided to the integrated circuit through a package pin. In other embodiments, $V_{EXT}$ is provided by a digital to analog converter (not shown).

In operation, $V_{EXT}$ is changed and the voltage on node 961 is monitored to determine the voltage value of $V_{REF}$. This is repeated while the integrated circuit is cycled in temperature. In this manner, $V_{REF}$ can be determined over temperature without the use of an A/D. Some embodiments include both comparator 960 and A/D 920 (FIG. 9A).

Figure 10:
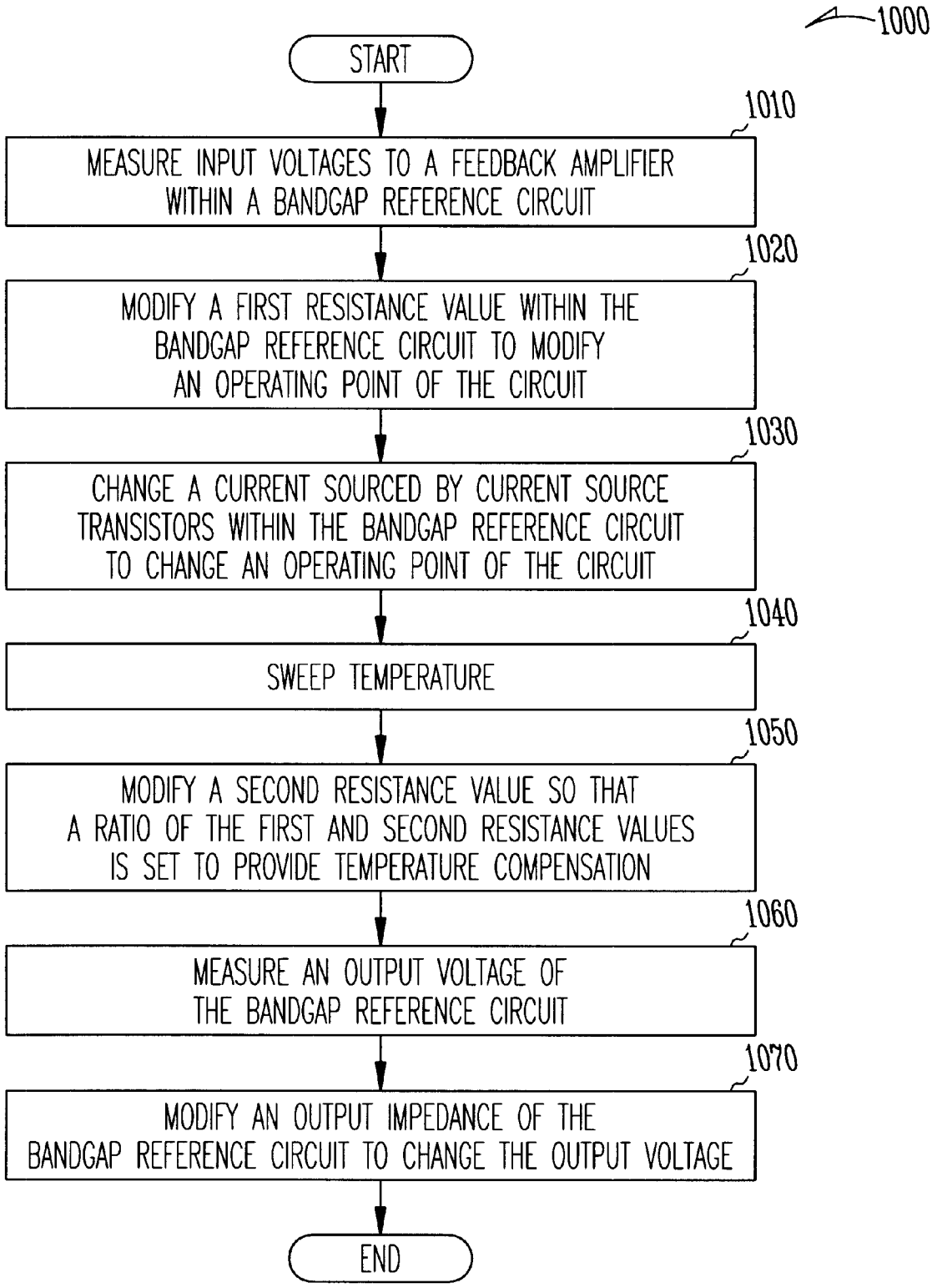
FIG. 10 shows a flowchart of a method for trimming a bandgap voltage reference circuit.

FIG. 10 shows a flowchart of a method for trimming a bandgap voltage reference circuit. Method 1000 begins at 1010 where input voltages to a feedback amplifier are measured within a bandgap reference circuit. This corresponds to a processor such as processor 810 (FIG. 8) reading voltage values $V_n$ and $V_p$ through the use of control circuit 850. At 1020, a first resistance value within the bandgap voltage reference circuit is modified to modify an operating point of the circuit. This can correspond to the modification of any variable resistance in the circuit of FIG. 8. In some embodiments, this corresponds to the modification of resistor 124 (FIG. 1). At 1030, a current sourced by current source transistors is changed to change the operating point of the circuit. Examples of variable current sources that can be changed in this manner are shown in FIGS. 5, 7, and 8. At this point in method 1000, the operating point of the bandgap voltage reference circuit is set. The operating point corresponds to the currents and resistance values that affect the operating voltage range of the input voltages to the feedback amplifier referred to in 1010.

At 1040 the temperature of the bandgap reference circuit is swept across a temperature range of interest. By changing the temperature of the circuit, the sensitivity to temperature of the bandgap reference circuit can be measured. In some embodiments, $V_{REF}$ is measured to check sensitivity to temperature. In other embodiments, $V_n$ and $V_p$ are measured to check sensitivity to temperature. At 1050, a second resistance value is modified to change the sensitivity to temperature. In some embodiments, the second resistance value is modified such that a ratio of the first and second resistance values is set to provide temperature compensation. This action corresponds to the modification of resistors 412, 422, or both (FIG. 4).

At 1060, an output voltage of the bandgap reference circuit is measured, and at 1070, an output impedance of the bandgap reference circuit is modified to change the output voltage. In some embodiments, these actions correspond to a processor reading the voltage value of $V_{REF}$ through the use of control circuit 850 (FIG. 8), and then writing data to memory mapped registers 930 (FIG. 9A).

The actions shown in method 1000 are not necessarily performed in the order presented. For example, a change in operating point can be effected prior to reading the values of $V_n$ and $V_p$, and resistance values and currents can be changed in any order. Furthermore, any actions within method 1000 can be omitted without departing from the scope of the present invention.

In some embodiments, method 1000 is performed when the bandgap reference circuit is manufactured. For example, an integrated circuit manufacturer that manufactures integrated circuits with bandgap reference circuits can perform method 1000 to determine suitable values for current sources and resistances. When a large lot of integrated circuits is manufactured simultaneously, method 1000 can be performed on a small number of the integrated circuits in the lot, and each integrated circuit can be set based on the results. In other embodiments, method 1000 is performed in end-user systems that employ bandgap reference circuits. For example, an end-user system with a particular reference voltage requirement can perform method 1000 to set the reference voltage value to a desired value. Also for example, an end-user system can modify the bandgap reference circuit to decrease temperature sensitivity over a particular temperature range.

Figure 11:
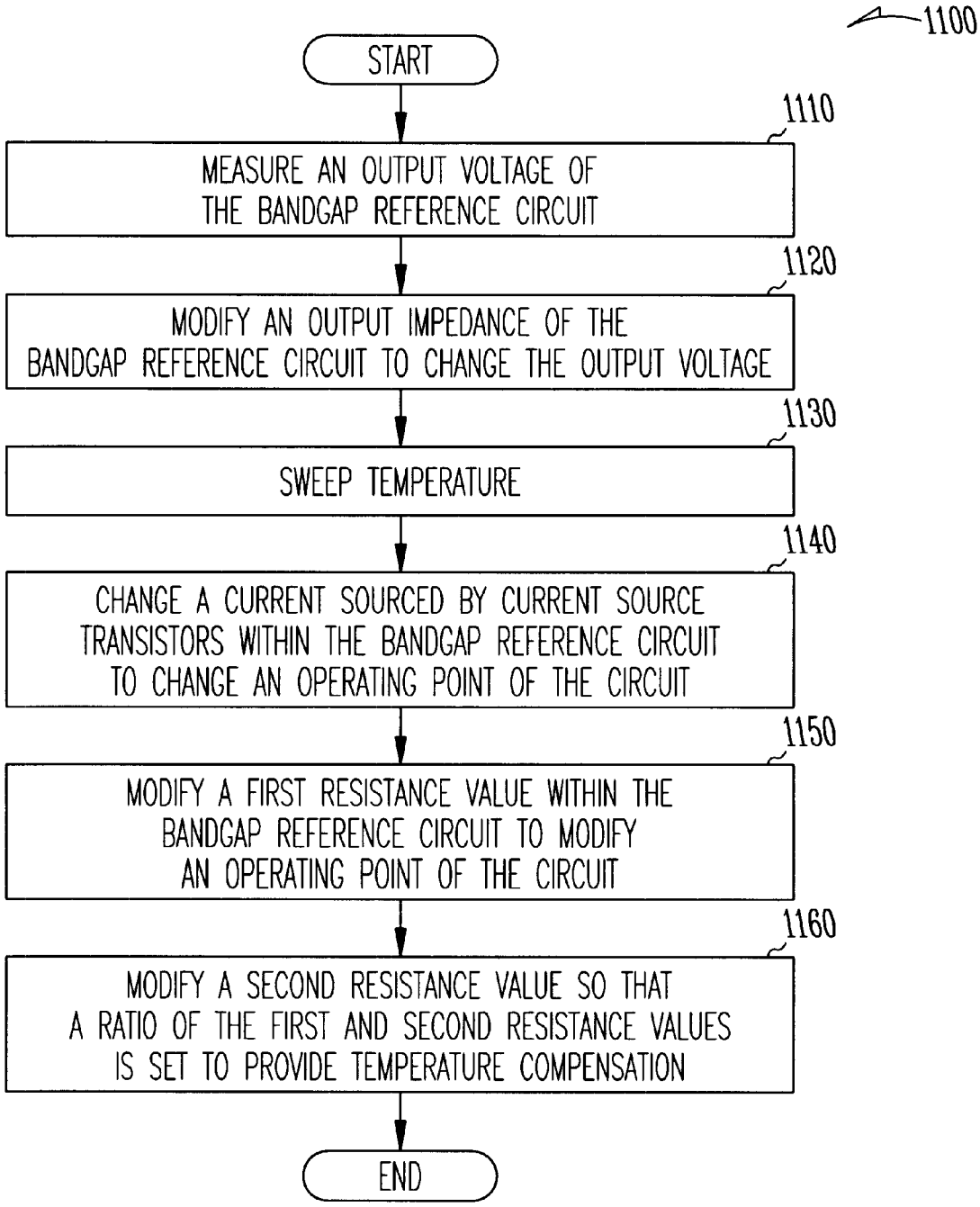
FIG. 11 shows a flowchart of an alternate method for trimming a bandgap voltage reference circuit.

FIG. 11 shows a flowchart of an alternate method for trimming a bandgap voltage reference circuit. Method 1100 begins at 1110, where an output voltage of the bandgap reference circuit is measured. At 1120, an output impedance of the bandgap reference circuit is modified to change the output voltage. The process of measuring and setting the output voltage is referred to as a "DC" (direct current) test, in part because no other variables are modified during the test In some embodiments, the DC test corresponds to a processor reading the voltage value of $V_{REF}$ through the use of comparator 960 (FIG. 9B), and then writing data to memory mapped registers 930.

At 1130 the temperature of the bandgap reference circuit is swept across a temperature range of interest. By changing the temperature of the circuit, the sensitivity to temperature of the bandgap reference circuit can be measured. In some embodiments, $V_{REF}$ is compared against an external voltage to check sensitivity to temperature. This can be performed using the circuitry shown in FIG. 9B. At 1140, 1150, and 1160, currents and resistance values are modified to change the operating point of the circuit and to provide temperature compensation.

Like method 1000 (FIG. 10), method 1100 can be performed by a manufacturer, an end-user, or any other entity that can benefit from trimming a bandgap reference circuit. Method 1100 has been described as practiced when a control circuit such as control circuit 901 (FIG. 9B) exists in an integrated circuit with the bandgap reference circuit, but this is not a limitation of the present invention. For example, the bandgap reference circuit can be trimmed using suitable control circuit capable of modifying resistance values or current sources.

Figure 12:
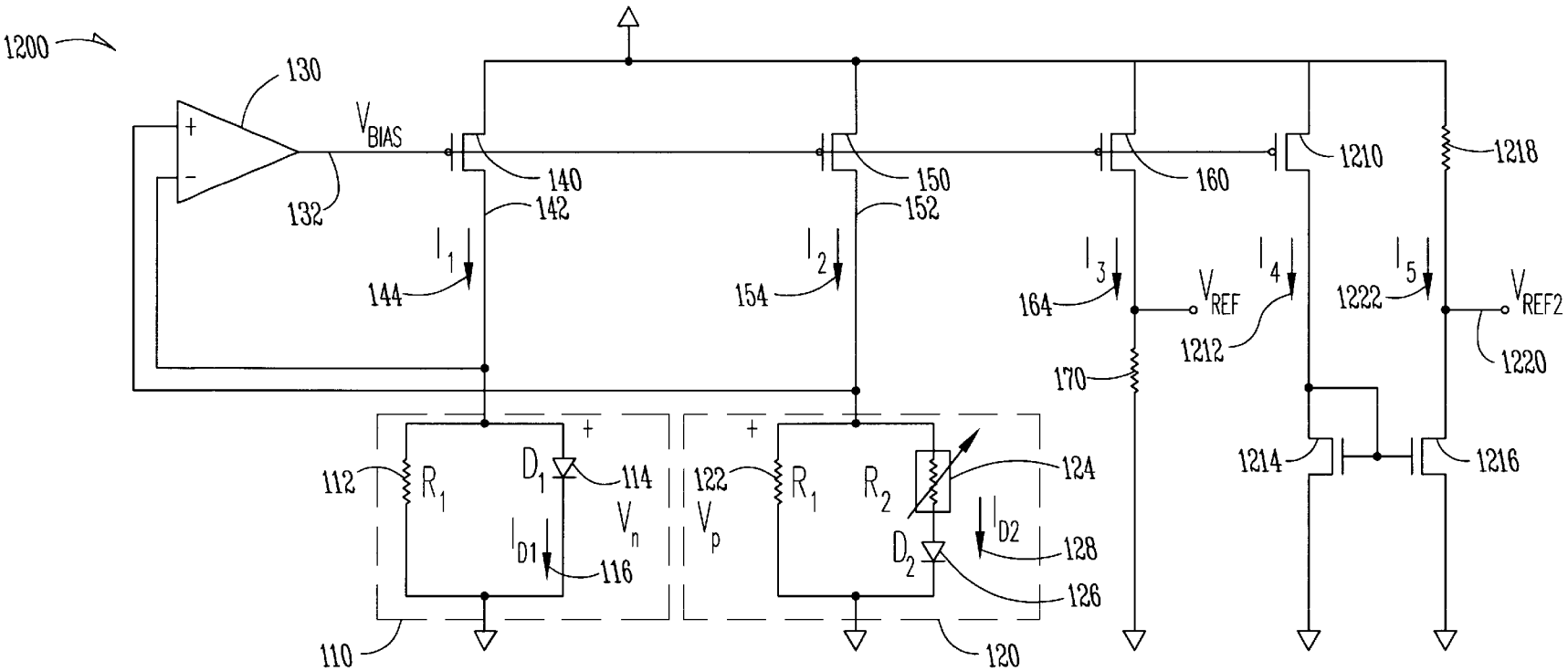
FIG. 12 shows a bandgap voltage reference circuit with multiple output voltages.

FIG. 12 shows a bandgap voltage reference circuit with multiple output voltages. Bandgap voltage reference circuit 1200 includes a circuit similar to that shown in FIG. 1 with an additional current mirror circuit to produce another output reference voltage $V_{REF2}$. The bias voltage on node 132 produced by differential amplifier 130 is used to bias current source transistor 1210, which in turn produces current 1212 ($I_4$). $I_4$ is mirrored through the action of transistors 1214 and 1216 to produce current 1222 ($I_5$). $I_5$ passes through resistor 1218 to produce $V_{REF2}$ relative to the positive voltage rail.

Bandgap voltage reference circuit 1200 simultaneously generates two reference voltages, one relative to the negative voltage rail, each relative to a different voltage supply. For example, $V_{REF}$ is generated relative to the negative voltage supply because current $I_3$ passes through resistor 170 which is connected to the negative voltage supply. Also for example, $V_{REF2}$ is generated relative to the positive voltage supply because current $I_5$ passes through resistor 1218 which is connected to the positive voltage supply. Any number of different reference voltages can be created using the method and apparatus of the present invention by adding more current mirrors such as that shown in FIG. 12. The different reference voltages can be referenced to either voltage supply shown in FIG. 12, or can be referenced to voltage supplies other than those shown.

In some embodiments, current source transistor 1210 is a variable current source and resistor 1218 is a variable resistor such as those shown in FIG. 8. In these embodiments, the multiple output reference voltages can be trimmed independently by setting either currents or resistances.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A bandgap voltage reference circuit comprising:

a first parallel combination circuit, and a first current source circuit coupled to develop a first voltage across the first parallel combination circuit;

a second parallel combination circuit, and a second current source circuit coupled to develop a second voltage across the second parallel combination circuit; and an amplifier 130 coupled to be responsive to the first and second voltages, the amplifier further coupled to influence the current sourced by the first and second current source circuits;

wherein at least one of the first and second current sources comprises parallel coupled selectable current source transistors.

2. The bandgap voltage reference circuit of claim 1 wherein the parallel coupled selectable current source transistors have gates coupled to the amplifier through individually selectable pass transistors.

3. The bandgap voltage reference circuit of claim 1 wherein the first parallel combination circuit comprises a resistor coupled in parallel with a diode.

4. The bandgap voltage reference circuit of claim 3 wherein the second parallel combination circuit comprises a resistor coupled in parallel with a series connected variable resistor and diode.

5. The bandgap voltage reference circuit of claim 4 wherein the variable resistor comprises a plurality of resistors, each coupled to a pass transistor having a fusible link on a control input.

6. The bandgap voltage reference circuit of claim 1 further comprising:

an output current source circuit; and a variable resistor coupled to the output current source circuit;

wherein a voltage reference output node is formed at a junction between the variable resistor and the output current source circuit.

7. The bandgap voltage reference circuit of claim 6 further comprising fusible links to set the variable resistor coupled to the output current source circuit.

8. The bandgap voltage reference circuit of claim 6 further comprising a scan data register to set the variable resistor coupled to the output current source circuit.

9. A bandgap voltage reference circuit comprising:

a first current source transistor, a first resistor, and a first diode, the current source transistor coupled to source current to a parallel combination of the first resistor and the first diode;

a second current source transistor, a second resistor, a second diode, and a third resistor, the second current source transistor coupled to source current to the second resistor coupled in parallel with a series combination of the second diode and third resistor; and an amplifier having input nodes coupled to the first and second resistors, and having an output node to provide a control voltage to the first and second current source transistors;

wherein the third resistor comprises a plurality of resistors, each in series with a select transistor.

10. The bandgap voltage reference of claim 9 further comprising an output current source transistor and an output resistor, the output current source transistor having a control input coupled to the output node of the amplifier.

11. The bandgap voltage reference circuit of claim 10 wherein the output resistor comprises a variable resistor.

12. The bandgap voltage reference circuit of claim 11 wherein the output current source transistor comprises a plurality of parallel transistors.

13. The bandgap voltage reference circuit of claim 9 wherein the first current source transistor comprises a plurality of parallel transistors.

14. The bandgap voltage reference circuit of claim 9 wherein the first and second resistors are variable resistors.

15. The bandgap voltage reference circuit of claim 9 further comprising a control circuit coupled to the select transistors of the third resistor to select a subset of the plurality of resistors.

16. The bandgap voltage reference circuit of claim 15 wherein the control circuit comprises a scan data register.

17. The bandgap voltage reference circuit of claim 15 wherein the control circuit comprises a memory mapped register.

18. The bandgap voltage reference circuit of claim 9 further comprising:

a third current source transistor, a current mirror coupled to the third current source transistor, the current mirror configured to provide an output voltage referenced to a voltage supply coupled to the first, second, and third current source transistors.

19. An integrated circuit comprising:

an amplifier coupled to be responsive to the difference of a first voltage and a second voltage, the amplifier having an output node to drive a plurality of current source transistors;

a first parallel combination of a first resistor and a first diode, coupled to at least one of the plurality of current source transistors, to develop the first voltage across the first resistor; and a second parallel combination of a second resistor and a series connected diode and variable resistor, coupled to a different at least one of the current source transistors, to develop the second voltage across the second resistor.

20. The integrated circuit of claim 19 wherein the variable resistor is coupled to a control circuit to set a resistance value of the variable resistor.

21. The integrated circuit of claim 20 wherein the control circuit comprises a fusible link circuit.

22. The integrated circuit of claim 20 wherein the control circuit comprises a scan data register.

23. The integrated circuit of claim 19 further comprising a variable output resistor and wherein one of the plurality of current source transistors is coupled to drive a current through the variable output resistor.

24. The integrated circuit of claim 19 wherein the integrated circuit is a circuit type from the group comprising: a processor, a processor peripheral, a memory, and a memory controller.

25. An article with a machine readable medium having instructions for a method of trimming a bandgap voltage reference circuit stored thereon, the method comprising:

measuring input voltages to a feedback amplifier within the bandgap voltage reference circuit;

modifying a first resistance value within the bandgap voltage reference circuit to modify an operating point of the circuit;

measuring an output voltage of the bandgap voltage reference circuit; and modifying an output impedance of the bandgap voltage reference circuit to change the output voltage.

26. The article of claim 25 wherein the method further comprises modifying a second resistance value so that a ratio of the first and second resistance values is set to provide temperature compensation.

27. The article of claim 25 wherein the method further comprises changing a current sourced by current source transistors within the bandgap voltage reference circuit to modify an operating point of the circuit.

28. The article of claim 27 wherein changing a current comprises selecting a subset from a set of parallel current source transistors.

29. The article of claim 25 wherein modifying a first resistance value comprises altering fusible links within the integrated circuit.

30. The article of claim 25 wherein modifying a first resistance value comprises shifting data into a scan data register.

* * * * *

UNITED STATES PATENT AND TRADEMARK OFFICE

CERTIFICATE OF CORRECTION

PATENT NO. : 6,501,256 B1 
DATED : December 31, 2002
INVENTOR(S) : Aaron K. Martin, James E. Jaussi and Stephen R. Mooney It is certified that error appears in the above-identified patent and that said Letters Patent is hereby corrected as shown below:

Title page,
Item [74], *Attorney, Agent, or Firm*, insert -- , -- after "Kluth".

Column 3,
Line 52, insert -- . -- after "($I_{D1}$)".

Column 13,
Line 26, delete "130" before "coupled".

Signed and Sealed this

Twenty-seventh Day of July, 2004

JON W. DUDAS
*Acting Director of the United States Patent and Trademark Office*